United States Patent [19]

Carveth

[11] Patent Number: 4,467,588

[45] Date of Patent: Aug. 28, 1984

[54] SEPARATED PACKAGING AND STERILE PROCESSING FOR LIQUID-POWDER MIXING

[75] Inventor: Peter Carveth, Glen Ellyn, Ill.

[73] Assignee: Baxter Travenol Laboratories, Inc., Deerfield, Ill.

[21] Appl. No.: 365,944

[22] Filed: Apr. 6, 1982

[51] Int. Cl.[3] ..... B65B 3/04; B65B 55/04; B65B 55/22

[52] U.S. Cl. ..... 53/425; 53/449; 53/468; 53/474; 604/87; 604/92; 604/410

[58] Field of Search ..... 53/425, 426, 468, 474, 53/492, 449, 469; 206/222, 219; 422/26, 302; 604/56, 82, 87, 92, 410, 408, 409; 427/443.2; 222/83, 94, 145

[56] References Cited

U.S. PATENT DOCUMENTS

| | | | |
|---|---|---|---|
| 2,283,867 | 5/1942 | Flosdorf | 53/474 |
| 2,358,570 | 9/1944 | Goldberg | 53/425 |
| 2,380,984 | 8/1945 | Moeller | 53/468 |
| 2,494,456 | 1/1950 | Still | 206/222 |
| 2,679,247 | 5/1954 | Mendez | 206/222 |
| 2,735,430 | 2/1956 | Huber . | |
| 2,800,269 | 7/1957 | Smith . | |
| 2,904,043 | 9/1959 | Friedman . | |
| 2,949,712 | 8/1960 | Bieberdorf | 53/468 |
| 2,955,595 | 10/1960 | Semple . | |
| 2,981,639 | 4/1961 | Kachele | 427/443.2 |
| 3,033,202 | 5/1962 | Richter et al. . | |
| 3,033,203 | 5/1962 | Barton . | |
| 3,043,067 | 7/1963 | Rynkiewicz | 53/426 |
| 3,058,799 | 10/1962 | Rowles | 422/26 |
| 3,059,643 | 10/1962 | Barton . | |
| 3,110,309 | 11/1963 | Higgins . | |
| 3,123,072 | 3/1964 | Bellamy, Jr. . | |
| 3,150,661 | 9/1964 | Maki . | |
| 3,336,924 | 8/1967 | Sarnoff et al. . | |
| 3,369,708 | 2/1968 | Hein . | |
| 3,375,824 | 4/1968 | Krakauer et al. . | |
| 3,416,657 | 12/1968 | Sorensen | 604/92 X |
| 3,470,867 | 10/1969 | Goldsmith . | |
| 3,477,432 | 11/1969 | Shaw . | |
| 3,490,437 | 1/1970 | Bakondy | 604/92 |
| 3,542,023 | 11/1970 | Ogle . | |
| 3,548,825 | 12/1970 | Shaw . | |
| 3,598,379 | 8/1971 | Laupheimer | 53/468 |
| 3,608,709 | 9/1971 | Pike . | |
| 3,659,602 | 5/1972 | Cloyd . | |
| 3,662,930 | 5/1972 | Meierhoefer . | |
| 3,783,997 | 1/1974 | Brown . | |
| 3,788,369 | 1/1974 | Killinger . | |
| 3,826,260 | 7/1974 | Killinger . | |
| 3,826,261 | 7/1974 | Killinger . | |
| 3,828,779 | 8/1974 | Ogle . | |
| 3,872,867 | 3/1975 | Killinger . | |
| 3,908,654 | 9/1975 | Lhoest et al. . | |
| 3,976,073 | 8/1976 | Quick et al. . | |
| 4,138,013 | 2/1979 | Okatima | 427/3 |
| 4,181,140 | 1/1980 | Bayham et al. . | |
| 4,223,675 | 9/1980 | Williams . | |
| 4,282,863 | 8/1981 | Beigler . | |
| 4,294,247 | 10/1981 | Carter et al. . | |
| 4,340,049 | 7/1982 | Munsch . | |

FOREIGN PATENT DOCUMENTS

| | | | |
|---|---|---|---|
| 1373027 | 8/1964 | France . | |
| 2006010 | 12/1969 | France | 604/82 |
| 2293916 | 12/1974 | France | 206/222 |
| 2473017 | 7/1981 | France . | |
| 1591989 | 7/1981 | United Kingdom . | |

OTHER PUBLICATIONS

U.S. Ser. No. 246,479, filed Mar. 23, 1981, Richmond, et al.

U.S. Ser. No. 365,940, filed Apr. 6, 1982, Schnell.

U.S. Ser. No. 365,942, filed Apr. 6, 1982, Pearson, et al.

Copy of Nutriflex® Container sold by Vifor, S. A., Geneva, Switzerland.

*Primary Examiner*—John Sipos

*Attorney, Agent, or Firm*—John P. Kirby, Jr.; Raymond M. Mehler; Bradford Price

[57] ABSTRACT

Provided is a process for preparing an aseptic container for separately storing a sterilized powdered component and a sterilized liquid component under clean conditions. The container includes two sealed chambers having a frangible, sterilized connection therebetween, one said chamber containing the liquid component, and the other said chamber including a sealed vial containing a powdered component. The vial has an outer surface that is aseptic throughout its entire surface area, and the frangible connection provides a sterile pathway, when desired, between the interior of the vial and the interior of the liquid-containing chamber.

14 Claims, 10 Drawing Figures

SEPARATED PACKAGING AND STERILE PROCESSING FOR LIQUID-POWDER MIXING

BACKGROUND AND DESCRIPTION OF THE INVENTION

This invention generally relates to a process and product for separately storing a sterilized powdered component and a sterilized liquid component within a single, aseptic unit container. More particularly, this invention relates to a process and product wherein two separate chambers are provided in a unit container or bag, which separate chambers are interconnected by a sterilized frangible connector that provides a closed connection between the chambers. Such closed connection is manually opened when it is desired to mix the liquid and the powder together in order to form a solution of the powder within the liquid, which solution is sterile and dispensible from the container in liquid form.

With regard to the dispensing of medicaments, it is often the case that the pharmaceutically active component is provided in powdered form and it is desired to administer the pharmaceutical within a carrier liquid, for example, in order to dispense the pharmaceutical by an intravenous procedure. Exemplary carrier liquids include saline solution, dextrose solution, and sterilized water. Often, such pharmaceutical powders are subject to deterioration if stored for long periods of time within the carrier liquid, as a result of which it is desirable to maintain the powdered component separate from the liquid component up until a time immediately prior to actual use by the physican or medical support staff. In such instances, it is typically desirable to avoid any possibility of contamination of the liquid-powder mixture, either before, during or after the liquid or powder components are mixed together. Besides the concern for maintaining clean conditions, it is also desirable at times to avoid exposure of the physician, medical support staff or pharmacist to certain unusually active drugs such as those used in chemotherapy treatment.

Powdered pharmaceuticals usually are sterilized by the drug manufacturer within a sterilized vial, typically of glass construction. Such vials have caps that are readily punctured in order to permit removal of the sterile powdered contents thereof into a carrier liquid or the like. Although these vials are usually provided in as clean a state as possible, the external features thereof do provide potential sources for mold or bacterial growth on the outside of the vial, such potential sources including the stopper and its overcap for sealing the mouth of the vial, the informational label that is affixed to the outside of the vial, and the adhesive utilized to affix the label. Nevertheless, because such vials have wide acceptance and enjoy a certain amount of uniformity throughout the medical industry, it is unlikely that the use of these vials in this manner will be phased out in the near future.

Mold or bacterial growth on the surface of non-porous containers or bags is sometimes observed when such bags are stored for substantial time periods within overpouches that serve as a barrier to the transmission of gas, light and water vapor to the bag within the overpouch. Often, because such barriers are not absolute or because some residual moisture remained between the bag and the overpouch at the time that the overpouch was sealed over the bag, mold growth can occur, especially since moisture and temperature conditions that are highly conducive to mold or bacterial growth are usually present between the bag and the pouch, or at other locations such as at an interface between a glass vial and support means therefor.

Accordingly, there is a need for a system that maintains sterile conditions within both a powdered pharmaceutical and its intended carrier liquid, while at the same time substantially eliminating any possibility of mold or bacterial growth between adjoining surfaces of the packaging for such sterilized medicaments. Also needed is a unitary device for separately packaging the carrier liquid and the powdered medicament that requires no direct contact with the rigid vial containing the powdered medicament, or the contents thereof, by the physician, pharmacist, or medical staff member. These needs are satisfied by the present invention through the use of several steps whereby a liquid component within a flexible container or bag is first sterilized under relatively harsh conditions, a sterilized powder-containing vial is maintained in an aseptic condition and is inserted into an enclosed chamber of the flexible bag and sealed therewithin.

It is accordingly a general object of this invention to provide a composite device for separate storage of a powder and a liquid.

Another object of this invention is to provide means for utilizing vials of powdered adhesive within a system that avoids potential sources of contamination originating from the vials.

Another object of the present invention is a product and process for its production whereby a sterile liquid and a sterile powder are separately packaged within a single unit in a manner that provides for mixing of the liquid and powder under sterile conditions.

Another object of this invention is an improved process for packaging a sterilized liquid carrier and a powdered pharmaceutical in a manner that minimizes any possible introduction of sources of bacteria, mold or the like either within or on the surface of the liquid container or the container for the powdered component.

Another object of the present invention is an improved product and process for its production wherein the entire outer surface of a powder-containing vial is rendered aseptic and packaged so as to be maintained in its aseptic condition.

Another object of the present invention is an improved process and product whereby a rigid vial is encapsulated in an aseptic state.

These and other objects of the present invention will be apparent from the following detailed description thereof, taken in conjunction with the accompanying drawings, wherein.

The device according to this invention includes a bag having a compartment 22 within which is sealed a carrier liquid, as well as a closed chamber 23 that is devoid of any carrier liquid therewithin and that is sized for sealing a standard sized rigid vial within such chamber 23. A frangible connector, generally designated as 25, enters both the liquid compartment 22 and the closed chamber 23. The bag and its liquid contents are sterilized.

Figure 1:
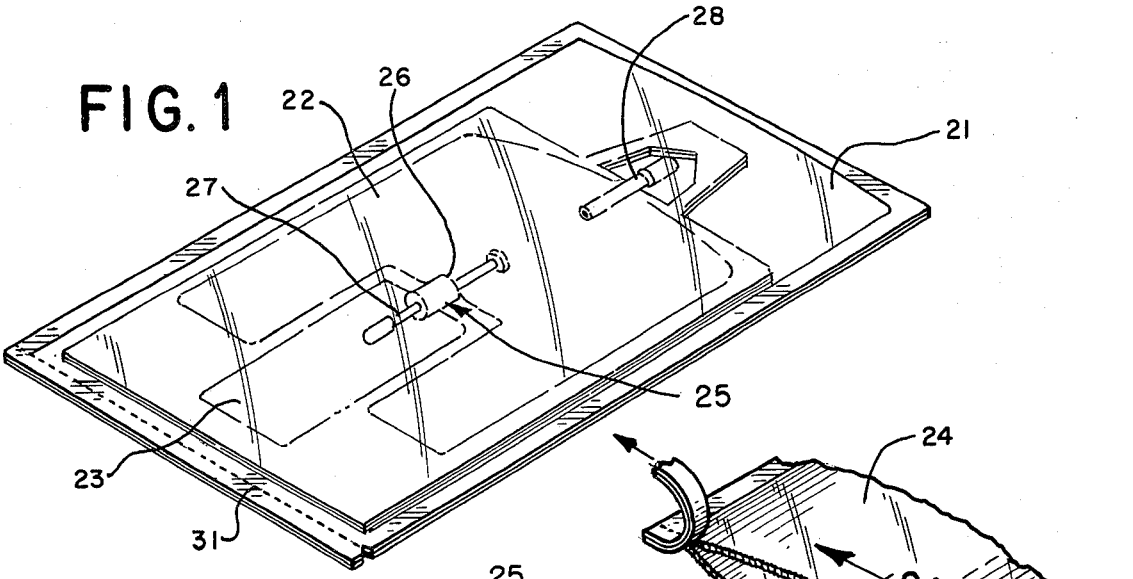
FIG. 1 is a perspective view illustrating an aspect associated with the sterilization of the flexible container and liquid solution therein prior to insertion of the powder-containing vial thereinto.

Often, the bag 21 as it is illustrated in FIG. 1 is sterilized some time prior to other operations to which the bag is subsequently subjected, in which case it is necessary to maintain the sterility of the bag 21 until such further operations are begun. Such can be accomplished by an overpouch 24, which may be sized as shown to fit a single bag 21 or sized to hold bulk quantities of such bags 21 in stockpile and/or storage.

The frangible connector 25 enters both the liquid-containing compartment 22 and the closed chamber 23, which frangible connector 25 is of known construction that includes means for blocking passage between the compartment 22 and the closed chamber 23. This blocking means is capable of being removed when desired in order to provide a sterile pathway for direct, liquid- and powder-passing communication between the compartment 22 and the closed chamber 23. Such frangible connector 25 typically includes a frangible cannula 26 and a rubber-tipped syringe 27, both of known construction. Bag 21 further includes an outlet member 28 whereby solution within the compartment 22 can be removed therefrom by opening the outlet member 28.

Figure 2:
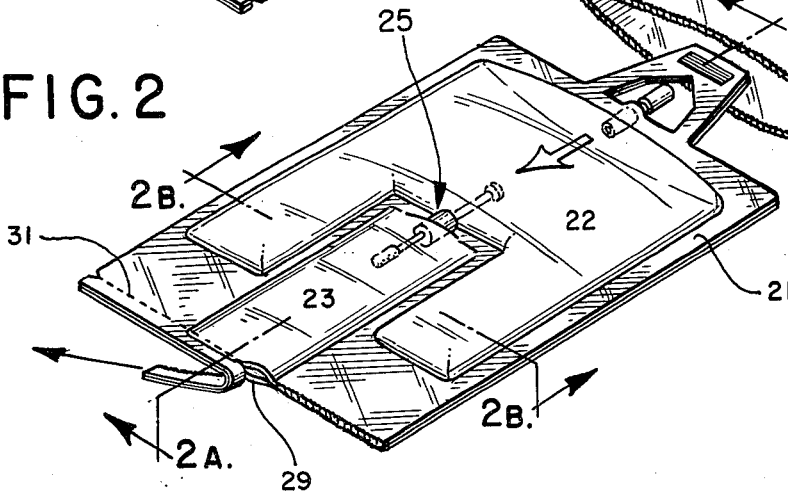
FIG. 2 is a perspective view of the flexible container of FIG. 1, showing access to the vial-receiving chamber of the device.
Figure 2A:
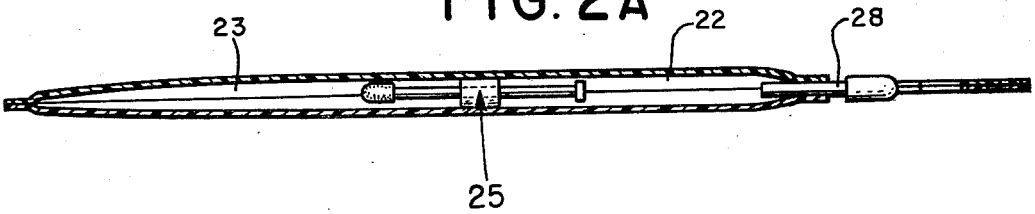
FIG. 2A is a longitudinal section of FIG. 2.
Figure 2B:
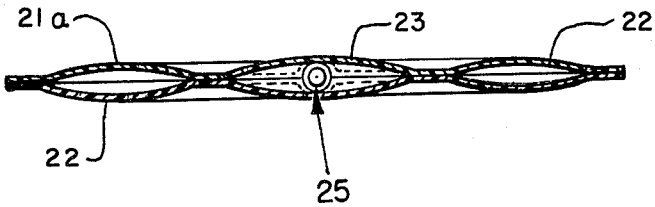
FIG. 2B is a transverse section of FIG. 2.

The step that is illustrated in FIGS. 2, 2A and 2B is carried out in a clean environment, for example within a so-called clean room or within a laminar flow unit of known construction that severely inhibits the passage of potential contaminants into such space while still providing a space that is accessible. Usually any such clean environment will assure maintentance of a bacterial count of about $10^3$, which is a bacterial count that is typically present on the outside surface of vials of commercially prepared powdered drugs. Within this environment, this step is carried out under clean conditions so as to avoid the addition of any significant contamination that might lead to future mold or bacterial growth either on the outside surface of the bag 21 or the vial or within the chamber 23 when the remote end 29 thereof is opened by slitting, tearing or the like to provide bag 21*a* in which the chamber 23 is open, such being illustrated in FIG. 2. This slitting or tearing can be assisted by providing a tear path 31 defining the edge of the remote end 29.

Figure 4:
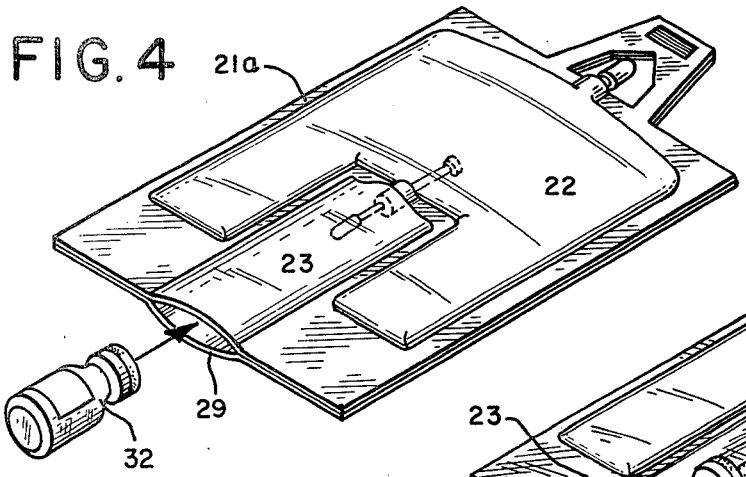
FIG. 4 is a perspective view of the flexible container of FIG. 1, illustrating insertion of the vial into the opened chamber.
Figure 5:
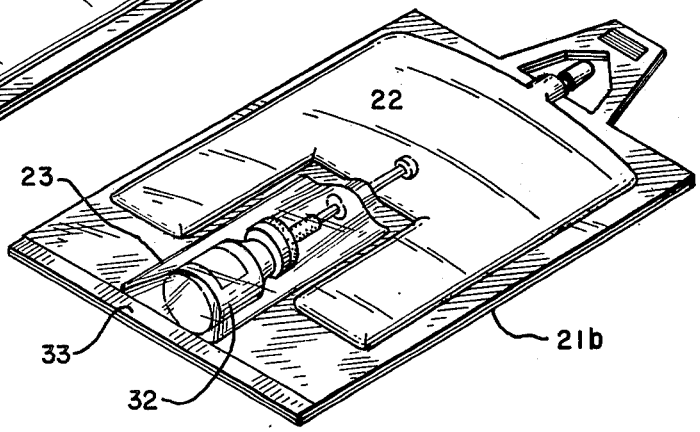
FIG. 5 is a perspective view of the flexible container of FIG. 1, illustrating the completed device after the opened chamber has been resealed with the vial therewithin.

With remote end 29 being open, a clean vial 32 is inserted into the chamber 23 while both the bag 21*a* and the clean vial 32 are within the clean environment. See FIG. 4. Thereafter, the open end 29 is resealed to form a seal 33 by heat-sealing or the like, as illustrated in FIG. 5, in order to provide a completed bag 21*b* having a clean vial 32 sealed within its closed chamber 23 and having a sterilized liquid within its compartment 22, such completed bag 21*b* having been prepared without having to sterilize the vial 32 under harsh sterilization conditions, such as elevated temperatures, which would be expected to lead to deterioration of or damage to the powder within the vial 32.

In order to enhance the maintenance of the clean outside surface of the completed bag 21*b*, it is preferred that such bag 21*b* be inserted into a barrier pouch 34, which may be the overpouch 24, another pouch identical thereto, or a different type of pouch that may exhibit especially excellent barrier properties with respect to light, gas, and/or water-vapor transfer.

Clean vial 32 can be provided by maintaining the vial 32 in an environment that maintains the aseptic or clean condition of the vial 32, especially its outside surface, after the vial 32 has been sterilized or, otherwise subjected to a sanitary treatment. Because most powdered pharmaceuticals cannot be subjected to autoclave conditions, the contents of the vial 32 are sterilized by a so-called dry procedure, such as known freeze drying sterilization techniques.

Figure 3:
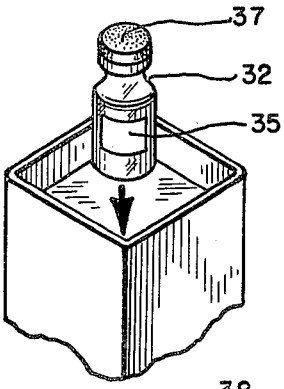
FIG. 3 is a view illustrating the preferred step of dipping the vial in order to encapsulate same in an aseptic condition.
Figure 6:
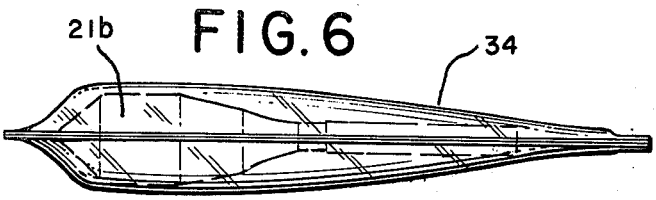
FIG. 6 is an elevational view illustrating a final protective overpouching of the completed device.

In an alternative aspect of this invention, the clean nature of the vial 32 is maintained and typically also enhanced by a dipping procedure illustrated generally in FIG. 3. This dipping procedure is especially effective when it is used to encapsulate the entire vial 32 within the dipping medium, along with any mold, bacteria or other contaminants that might remain on the outside surface of the vial 32. Contaminants are most likely to collect under or within the label 35 or under the cap of the vial 32. Labels, which are typically made of a cellulosic material, present a difficult problem with regard to the maintenance of aseptic conditions. For example, such labels tend to attract and retain moisture, thereby providing conditions that are very favorable to mold growth.

This dipping procedure may take a variety of forms. Preferably, such dipping procedure includes dipping within a molten thermoplastic material that hardens or sets upon cooling in order to both raise the surface temperature of the vial to assist in reducing the quantity of mold or bacterial materials remaining on the surface while also serving to seal the entire vial and any residual bacterial materials within the set thermoplastic material. By this sealing, the growth of any bacterial materials will be severely inhibited if not prevented, while at the same time, the hardened thermoplastic material will prevent migration of any such residual bacterial materials to the interior of the vial 32, the interior of the chamber 23, or other locations within or on the bag 21. Suitable thermoplastic materials include synthetic rubbers and polymers such as polyvinyl chloride, silicone rubber, and copolymers including block polymers, whether of the linear or radial type. Any number of these types of thermoplastic materials may be used, although any such material preferably should be relatively transparent to the extent that information contained on the label 35 may be readable therethrough.

Other dipping materials may be utilized, including topical antiseptics such as Betadine (Registered Trade Mark), or the like. These types of dipping substances are less preferred because of the fact that they tend to stain the vial label 35, which is usually made of a cellulosic material. The usefulness of these types of dipping substances is limited by the extent that such staining renders the label information unintelligible.

The dipping procedure can also include passing through a sterilizing light source such as ultraviolet sources or by a pasturization type of rinsing procedure. These are typically less desirable because these procedures do not encapsulate the entire vial in the strict sense that thermoplastic materials do, and they do not perform the function of preventing migration of residual bacterial matter from the outside surface of the vial 32.

Figure 7A:
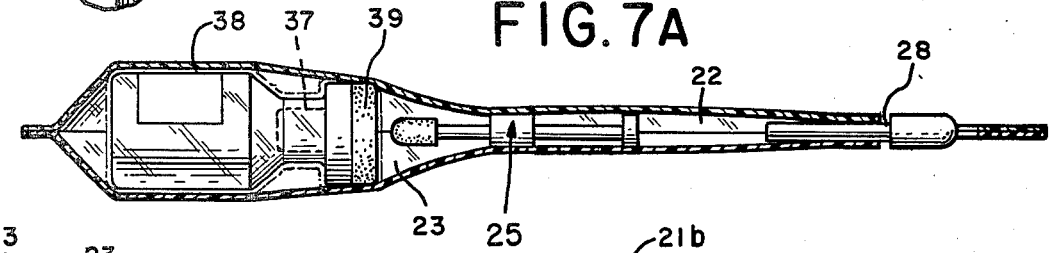
FIG. 7A is a longitudinal section of FIG. 7.
Figure 7:
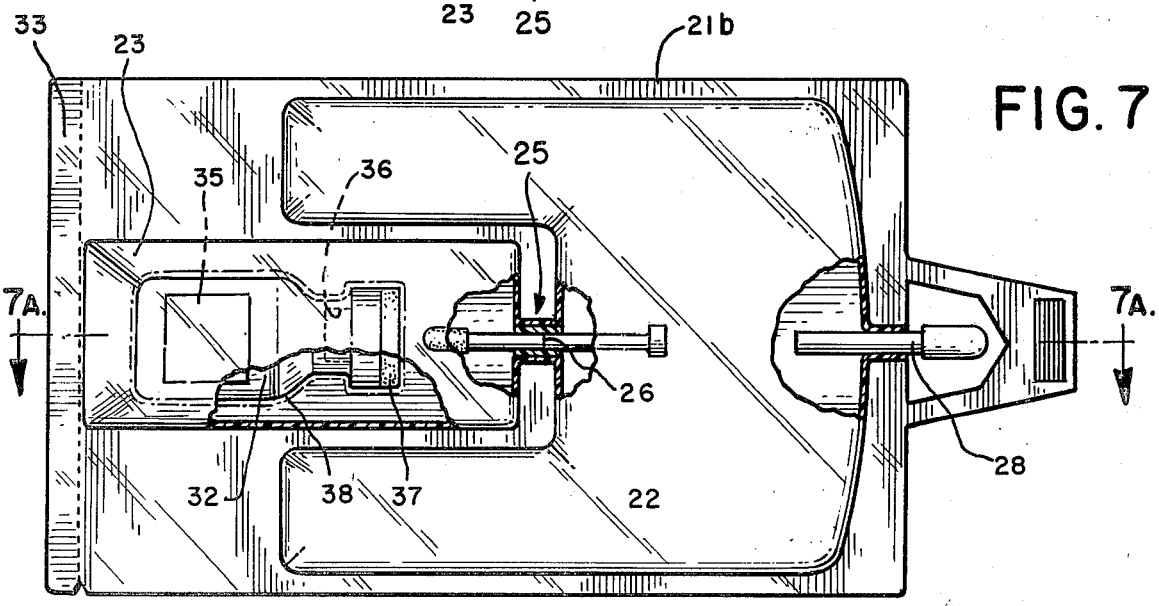
FIG. 7 is a top plan view, partially broken away, of the device as it is shown in FIG. 5.

While it is desirable to utilize containers that have long been in use because of their proven effectiveness in avoiding contamination and deterioration of the powderedcomponent, the present invention is able to effect a modification of these traditional vials by the elimination, in many instances, of an overcap, which is typically a metal cap having means to provide easy access to the central axis of a rupturable plug 37 within the neck opening 36 of the vial 32. This is illustrated in FIGS. 7 and 7A, wherein the clean vial 32 has its opening 36 closed only with the rupturable plug 37. No overcap is required to securely hold the rupturable plug 37 in place by virtue of a full peripheral encapsulation 38 which is molded over the entire vial 32 including an external flange 39 of the rupturable plug 37.

Such elimination of an overcap, which overcap is a potential source of contamination, is possible even when the full peripheral encapsulation 38 is not a thermoplastic material that serves to provide mechanical assistance in maintaining the rupturable plug 37 in place. Since the chamber 23 is completely closed and closely overlies the vial 32, there is little chance that the rupturable plug 37 will be loosened from the neck opening 36 of the vial 32, which could result in spilling and waste of the powder within the vial 32, as long as the rupturable plug 37 is slightly oversized with respect to the neck opening 36 in order to provide frictional engagement between the rupturable plug 37 and the neck opening 36.

Elimination of an overcap with respect to any embodiment of this invention is further possible in view of the fact that the closed chamber 23 itself is a closed, clean environment, thereby precluding contamination of the powder within the vial 32 by sources within or external to the closed chamber 23. Moreover, the closed chamber 23 provides no accessible structure, such as a narrow pocket or a crevice, that has the potential to cause retention of contamination or moisture that have been introduced during cleaning the closed chamber 23 before sealing thereof. Additionally, since all compartments of the completed bag **21*b* are closed and sealed, including the chamber 23, the entire outside surface of the completed bag 21*b* is also devoid of pockets or crevices which could lead to undesirable retention of contaminants and/or moisture prior to insertion thereof into the barrier pouch 34**.

With more particular reference to the method aspects of this invention, the bag 21 is sterilized, usually by a steam autoclave procedure at about 250° F., typically while within an autoclave overpouch 24, made of a material such as a high density polyolefin. These materials, including high density polyethylene and polypropylene, may be exceptionally thin, for example as low as 1.5 mil, depending upon the length of time that the initial overpouching protection is needed. Rarely will the gauge of such materials have to equal or exceed 10 mils.

At the time that the vial 32 is to be inserted into the bag 21, the overpouch 24 is removed from the bag 21 within a clean environment, and the remote end 29 of the chamber 23 is opened. The interior of the chamber 23 should, after this procedure, still be sterile or at least in an aseptic condition. If desired, the open chamber 23 can be cleaned, for example, by a water wash at between about 110° to about 180° F., followed by blow drying thereof and, if necessary, treatment with ultraviolet light. Thereafter, the vial 32, after having been subjected to dipping if desired, is dried if necessary and sealed into the chamber 23, this operation being carried out within the clean environment.

If completed bag **21*b* is to be sealed within a barrier pouch 34, the outer surface of bag 21*b* may be clean enough to avoid mold or bacterial growth upon lengthy storage. Aseptic conditions can be enhanced by one or more procedures, including hot water rinsing at about 110° to about 180° F., blow drying with filtered air and ultraviolet light treatment. The interior of the barrier pouch 34 may itself be subjected to such types of treatments to insure its aseptic condition in order to minimize the possibility of mold or bacterial growth at the interface between the completed bag 21*b* and the barrier pouch 34**.

Barrier pouch 34 need not be made of an autoclavible material since the barrier pouch 34 does not undergo a steam sterilization procedure. The most important property for such barrier pouch 34 is its barrier effectiveness, that is its ability to minimize passage of light, gas and moisture therethrough in order to protect the sensitive products therewithin. If convenient, the previously removed, autoclavable overpouch 24 can be employed as the barrier pouch 34, although the additional handling attendant to such procedure increases the risk that the barrier could be broken by flex crack pin holes that tend to develop during rough handling of thin, high density polyolefin materials. When a completely different barrier pouch 34 is used, possible materials therefor include saran-polypropylene laminates, vinyl films or laminates including vinyl films, and a pouch in which one side or panel is made of an opaque material that is an exceptionally good barrier, such as metal foil, with the other side or panel being made of a transparent material that need not be an exceptional barrier. For example, such other side panel can be a thin high density polyolefin on the order of 5 mils or less since the absolute barrier panel halves the effective transfer through the other panel when the pouch is considered as a whole.

It will be apparent to those skilled in this art that the present invention can be embodied in various additional forms; accordingly, this invention is to be construed and limited only by the scope of the appended claims.

I claim:

1. A process for producing an integral aseptic container for separately storing, mixing, and dispensing a sterilized powdered component and a sterilized liquid component in a manner that provides for mixing and dispensing of said powdered and liquid components under sterile conditions within said integral container, comprising:

providing a container having at least two separate and distinct compartments having a frangible connection therebetween, one such compartment having a dispensing outlet portion, another such compartment being for receiving a vial;

sealing the vial-receiving compartment to form a closed chamber that is devoid of any carrier-liquid and of any powdered component;

filling the compartment having the dispensing outlet portion with a carrier liquid;

sealing the compartment having the dispensing outlet portion to seal the carrier liquid therewithin;

sterilizing said container including said carrier liquid compartment, said closed chamber, including the interior thereof said frangible connection and said sealed dispensing portion while said closed chamber remains devoid of any carrier liquid and of any powdered component during said sterilizing step;

opening, subsequent to said sterilizing step, an end of said closed chamber of the sterilized container while said container is within an aseptic environment;

inserting a sealed vial into the chamber through the end that was opened during said opening step and while said container is within an aseptic environment, said vial containing a sterilized powdered component therewithin, said inserting step including positioning the sealed vial such that, when its seal is broken, the powdered component will enter into said frangible connection between the carrier liquid compartment and said chamber; and sealing, subsequent to said inserting step, said open end of said chamber while said container is within an aseptic environment, thereby sealing the vial within said chamber.

2. The process of claim 1, further including dipping said sealed vial into a dipping medium prior to said step of inserting the sealed vial into the chamber.

3. The process of claim 1, further including encapsulating the entire external surface of said sealed vial within a dipping medium prior to said step of inserting the sealed vial into the chamber.

4. The process of claim 1, further including encapsulating said sealed vial with a thermoplastic material before said step of inserting the sealed vial into the chamber.

5. The process of claim 1, further including encapsulating said sealed vial within a dipping medium prior to said step of inserting the sealed vial into the chamber, said dipping medium being a topical antiseptic.

6. The process of claim 1, further including encapsulating said sealed vial within a dipping medium prior to said step of inserting the sealed vial into the chamber, said dipping medium being a sterilizing light source.

7. The process of claim 1, further including encapsulating said sealed vial within a dipping medium prior to said step of inserting the sealed vial into the chamber, said dipping medium being a hot water wash.

8. The process of claim 1, further including maintaining the sterilized condition of said container prior to said step of opening an end of said chamber.

9. The process of claim 8, wherein said maintaining step includes packaging the sterilized container within an overpouch until said chamber end is opened within an aseptic environment.

10. The process of claim 1, further including maintaining the outside surface of the container in an aseptic condition after said step of sealing the vial within said chamber.

11. The process of claim 10, wherein said maintaining step includes packaging the vial-containing sealed container within a barrier pouch to retard the transfer of light, gas and water vapor to the container.

12. The process of claim 1, wherein said step of sterilizing the container includes autoclaving said flexible bag.

13. The process of claim 1, further including subjecting the interior of said chamber to an aseptic treatment after said step of opening said chamber and before said step of sealing the vial within the chamber.

14. The process of claim 1, further including subjecting the exterior of the sealed container to an aseptic treatment after said step of sealing the vial within the chamber.

* * * * *

UNITED STATES PATENT AND TRADEMARK OFFICE

CERTIFICATE OF CORRECTION

PATENT NO. : 4,467,588

DATED : August 28, 1984

INVENTOR(S) : Peter Carveth

It is certified that error appears in the above–identified patent and that said Letters Patent are hereby corrected as shown below:

At column 7, line 5, insert a comma after the word "thereof".

At column 8, lines 28 and 29, delete "flexible bag" and substitute "container" therefor.

Signed and Sealed this

*Eighth* Day of *January 1985*

[SEAL]

*Attest:*

*Attesting Officer*

GERALD J. MOSSINGHOFF

*Commissioner of Patents and Trademarks*